United States Patent [19]

Hyde

[11] Patent Number: 4,643,419

[45] Date of Patent: Feb. 17, 1987

[54] FIXED EXERCISE PLATFORM APPARATUS AND METHOD

[76] Inventor: Henry D. Hyde, 3229 Park Hills Dr., Austin, Tex. 78746

[21] Appl. No.: 695,546

[22] Filed: Jan. 28, 1985

[51] Int. Cl.[4] ..... A63B 21/00

[52] U.S. Cl. ..... 272/73; 272/70

[58] Field of Search ..... 272/70, 73, 96, 97; D21/191-198; 280/220, 221, 261

[56] References Cited

U.S. PATENT DOCUMENTS

| | | | |
|---|---|---|---|
| 1,796,682 | 3/1931 | Bell | 272/73 |
| 3,212,776 | 10/1965 | Bassler | 272/73 |
| 3,511,500 | 5/1970 | Dunn | 272/70 |

FOREIGN PATENT DOCUMENTS

| | | | |
|---|---|---|---|
| 45140 | 11/1888 | Fed. Rep. of Germany | 272/70 |
| 2428515 | 1/1976 | Fed. Rep. of Germany | 272/73 |
| 494462 | 10/1938 | United Kingdom | 280/261 |

*Primary Examiner*—Richard J. Apley
*Assistant Examiner*—S. R. Crow
*Attorney, Agent, or Firm*—John N. Shaffer, Jr.

[57] ABSTRACT

Apparatus and method of providing for a secure, rigidly positioned exercise platform to be utilized in conjunction with a fixed standup or sitdown cycling machine or any ordinary moveable cycling device. The device utilizes two oppositely positioned exercise platforms fixedly attached to platform shafts. These platform shafts are supported by carrier housings that are attached to a main shaft by means of a spacing and support bar. Stationary gears are attached to the ends of each platform shaft and are oppositely attached to the ends of the main shaft carrier housing. A free spinning connection means, in the form of a belt or a gear, is employed to connect the platform shaft gears and main shaft carrier housing gear. In operation, as a result of this configuration, the exercise platforms are held in a fixed position throughout the exercise cycle. The free spinning connecting means will "walk" around the stationary gears allowing for movement of the platforms while at the same time holding the platforms in their fixed positions. The device is specifically designed to be used by anyone in a desirable, safe, indoor, exercising environment and will also alleviate the problem of free moving pedals wiht pose a danger to the infirm or aged persons desiring exercise on a typical exercising machine. The angle of the platforms is easily adjustable should a different angle be desired. The device is rugged, easy to inspect, maintain and disassemble and is relatively inexpensive to produce.

6 Claims, 5 Drawing Figures

FIXED EXERCISE PLATFORM APPARATUS AND METHOD

BACKGROUND OF THE INVENTION

1. Field of the Invention

This invention pertains to a device designed to provide for a fixed exercise platform. The gist of the invention is a two pedal exercising device which is operated like a normal bicycle. Unlike a normal bicycle, however, the pedal platforms are held in a fixed position throughout the cycling motion. This position is maintained by the utilization of stationary gears or sprockets connected by a free spinning connecting means in the form of a timing chain, belt, or another gear. As a result of this free spinning connecting means, a person utilizing this device may step upon the exercising platforms at any point and be assured that the platform itself will remain in a fixed position. Should an exerciser desire the angle of the exercising platform to be located in another fixed position, this can be simply and securedly done.

2. Description of the Prior Art

While there are numerous types of exercising platforms, to the best of this inventor's knowledge, there has never been an invention such as this which is capable of maintaining the exercising platform in a fixed, secure position at any position in the exercising cycle while at the same time allowing the exercising device to be utilized in a cycling motion. In this inventor's experience, every device that has been designed to attempt to provide for a secure, level platform has failed in this attempt as they are not really secure nor capable of providing a normal cycling motion if the platform is secured in some manner. Previous inventions have attempted to overcome the problem of maintaining the platform in a secured position, so that an exerciser can confidently step upon the device without the pedal rotating uncontrollably, in several ways. One such way was by weighting the base of the pedal so that it maintained a level attitude. Various other exercising devices have presumed that exercisers utilizing their devices had no need for a secure platform for their feet. In this regard anyone desiring a secure platform, and especially persons recovering from injuries or elderly persons lacking the physical skills necessary to maintain balance on these previous devices, were thwarted in their ability to obtain exercise on a safe and secure exercising device.

SUMMARY OF THE INVENTION

This invention consists of a stationary exercising platform. The platform is composed of two oppositely positioned foot pedals or exercising platforms. The exercising platforms are covered with a cushioning material such as foam rubber or a rubber pad of some sort. The platforms are attached to platform shafts which are, in turn, supported by carrier housings which are securably attached and spaced apart from the main shaft by means of a spacing and support bar. A stationary gear is attached to the opposite end of the platform shafts and the main shaft carrier housing has two oppositely positioned stationary gears as well. A free spinning connecting means in the form of a "timing" belt, a chain, or a free spinning gear connects the main carrier housing gear and platform shaft gears. It is by means of the free spinning connecting means that the platforms are held ridgedly in position while allowing normal cycling motion to be obtained. The end result is an exercise platform upon which an exerciser may step at any position of the cycling motion and know that the platform itself will be fixed in a secure, immovable position.

The object of the invention is to provide a device that is easy and safe to use. A device that provides for a safe and secure platform upon which individuals, especially the weak or aged, may step without fear that the exercising platforms will wobble uncontrollably. The device may be utilized in the standing or sitting position as an exerciser may desire. Further, the device is rugged, easy to disassemble and relatively inexpensive to produce and may be incorporated into moveable as well as fixed exercise devices.

BRIEF DESCRIPTION OF THE DRAWINGS

For a description of the construction and operation of the device of this invention, reference is made to the attached drawings and identical reference characters will be utilized to refer to identical or equivalent structures throughout the various views of the following detailed descriptions.

DETAILED DESCRIPTION

Figure 2:
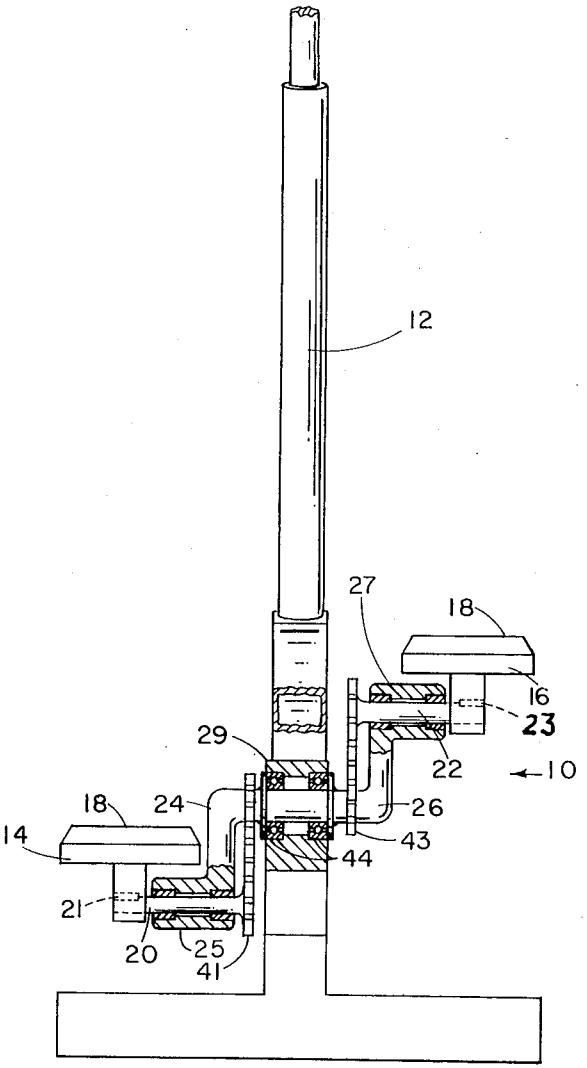
FIG. 2 is a back view of the device attached to the standup exercising means.
Figure 1:
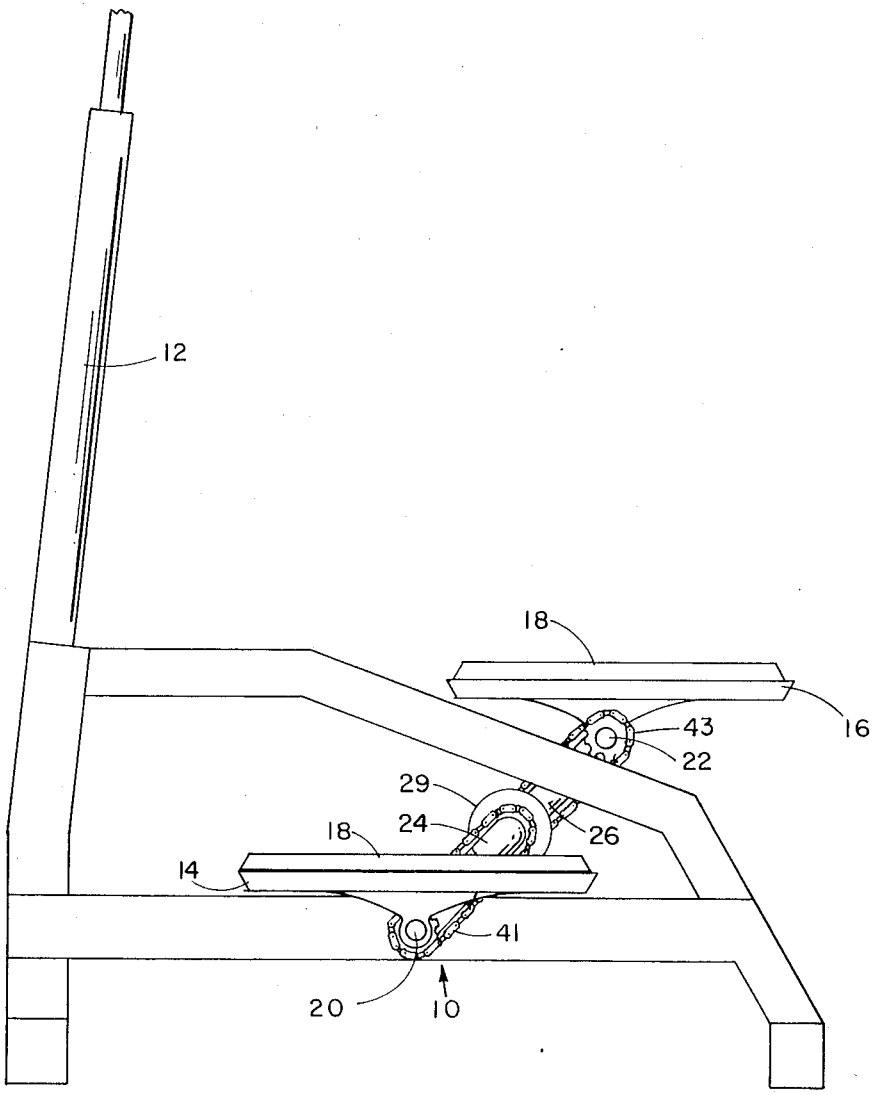
FIG. 1 is a side view of the device as attached to a fixed, standup exercising means.

Referring to FIG. 1, 10 denotes the invention itself attached to a standup exercising frame 12. The device consists of two oppositely attached exercise platforms 14 and 16 to which is attached a cushioning means 18, such as foam rubber. Referring to FIG. 2, it can be seen that said exercise platforms 14 and 16 are attached to platform shafts 20 and 22 by keys 21 and 23. Additionally, spacing and support bars 24 and 26 are attached to platform shaft carrier housing 25 and 27 on one end.

Figure 3:
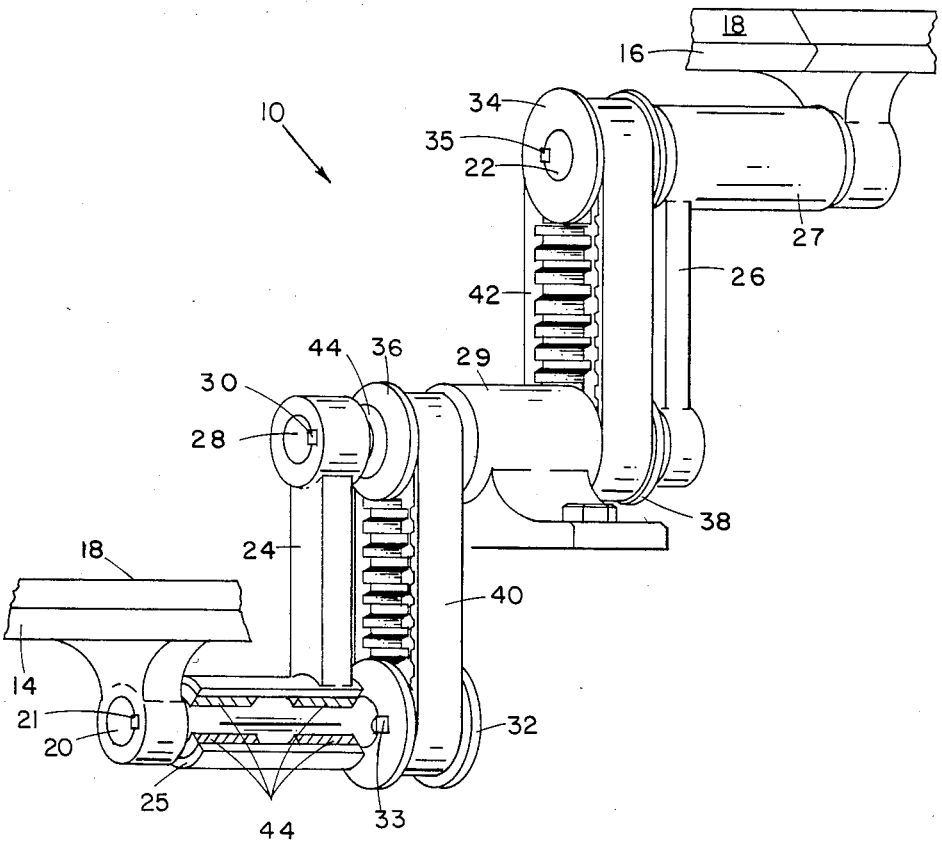
FIG. 3 is a side elevational view of the platforms illustrating the free spinning connecting means in the form of a belt.

It can be seen in FIG. 3 that said spacing and support bars 24 and 26 are connected on the other end to the main shaft 28 by locking key 30. Also illustrated are stationary gears 32 and 34 attached to platform shafts 20 and 22. Oppositely positioned stationary gears 36 and 38 are shown attached to said main shaft carrier housing 29. Free spinning connecting means 40 and 42 illustrate the connection of said stationary gears 32, 34, 36 and 38 in the form of belts. FIG. 1 shows free spinning connecting means in the form of a chain 41 and 43. Brass bushings 44 are pressed inside all carrier housings in order to allow for rotation while maintaining the platforms in a fixed position.

Figure 5:
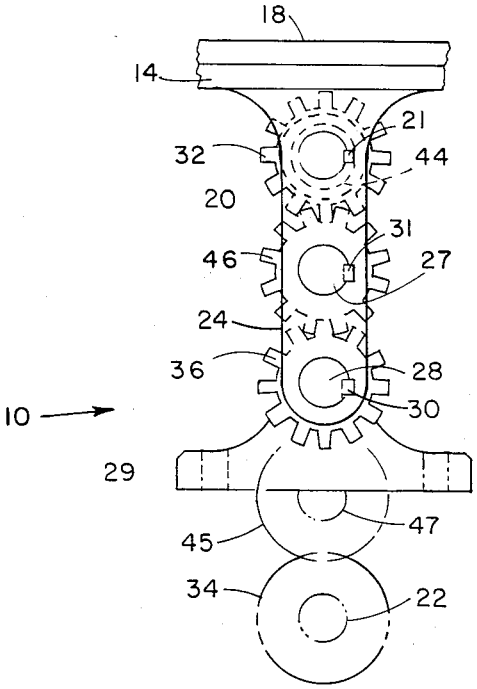
FIG. 5 is a front elevational view of the gears illustrated in FIG. 4.
Figure 4:
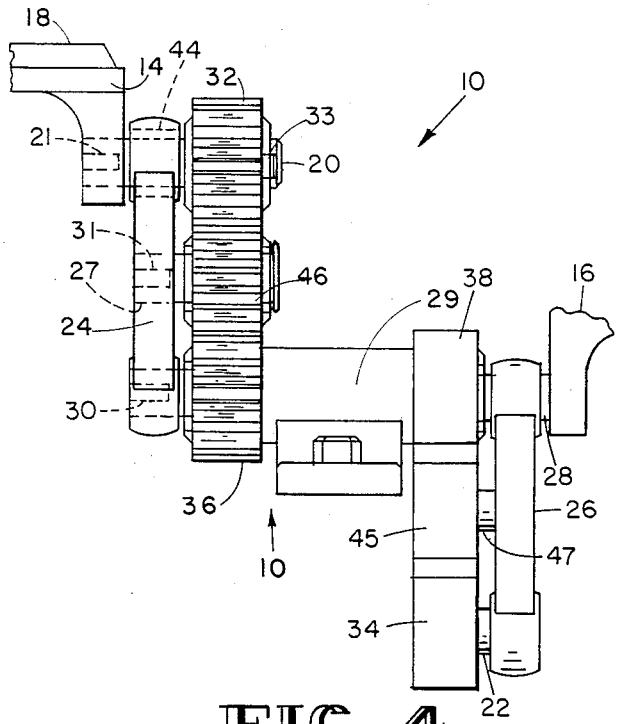
FIG. 4 is a partial side elevational view illustrating the use of the free spinning connecting means in the form of a gear.

FIG. 4 illustrates the embodiment of said device 10 wherein said free spinning connecting means is in the form of a free spinning spur gear 46. In this embodiment, stationary spur gears 32 and 36 are in direct contact with said free spinning spur gear 46. As shown in FIG. 5, the direct contact between the spur gears allows for the cycling motion while maintaining platforms 14 and 16 in a stationary, fixed position.

In use, the device 10, as illustrated in FIG. 3, enables an exerciser to stand upon a stable platform at any point in the cycling motion. This is accomplished, in this embodiment, through utilization of two oppositely attached exercise platforms 14 and 16. Said platforms 14 and 16 are covered with a cushioning material 18. Said platforms 14 and 16 are attached to platform shafts 20 and 22 by means of platform shaft keys 21 and 23. Spacing and support bars 24 and 26 are attached to platform shaft carrier housings 25 and 27 and to main shaft 28. Stationary timing gears 32 and 34 are attached to the ends of said platform shafts by keys 33 and 35. Two oppositely attached stationary timing gears 36 and 38 are attached to main shaft carrier housing 29. Free spinning connecting means 40 and 42 connect said stationary gears 32, 34, 36 and 38. Bushings 44 are pressed inside carrier housings to provide for movement of the device as said platforms 14 and 16 remain in a ridgedly fixed position throughout the cycling motion and to provide for rotation of said shafts throughout said motion.

In another embodiment, device 10, as shown in FIG. 5, employs the use of a free spinning connecting means in the form of a spur gear 46. Said spur gear 46 is in direct contact with stationary spur gears 32 and 36. Said contact allows for the fixing of the exercise platform in a stationary position throughout the cycling motion while allowing the cycling motion to be obtained.

Thus, according to this invention, an exercising device is provided for which allows a person to step on the exercising platforms at any point in the exercising cycle and obtain a sure, secure, and ridged footing. This security is provided for by means of the utilization of a series of stationary gears connected by a free spinning connecting means in the form of a timing belt, chain or a gear. The angle of the platforms may be changed to any position the exerciser desires by conventional mechanical means such as a set screw. Once that position is obtained, the free spinning connecting means will maintain that position in a secure and fixed manner until the exerciser purposefully changes it. The device is easy to operate, mechanically simple, and easy to inspect, clean and repair. Further, the device is rugged, easy to disassemble and relatively inexpensive to produce.

Altough the invention has been described in connection with the preferred embodiment, it is not intended to limit the invention to the particular form set forth, but, on the contrary, it is intended to cover alternatives, modifications, and equivalents as may be included within the spirit and scope of the invention as defined by the appended claims.

What is claimed is:

1. A fixed exercise cycling platform apparatus for supporting an exerciser comprising:

a. a pair of support platforms upon which an exerciser's feet may be placed;

b. resilient cushioning means attached to said support platforms for cushioning said exerciser's feet;

c. platform shafts with one end of said platform shafts fixedly attached to the base of said support platforms so that said support platforms may be positioned at any desired angle and held there;

d. a pair of stationary platform gear means attached to said platform shafts at the end of said platform shafts opposite from said support platforms;

e. a pair of spacing and support bars securably attached at one end to platform shaft carrier housings, which surround said platform shafts between said support platforms and said stationary platform gear means and which include bushings so that said platform shaft rotates freely within said shaft carrier housings;

f. a main shaft fixedly attached to the ends of each said spacing and support bars opposite from said platform shaft carrier housings;

g. two oppositely positioned stationary main shaft carrier housing gear means aligned with said stationary platform gear means, fixedly attached to a main shaft carrier housing, which encloses said main shaft and includes bushings which enable said main shaft to rotate freely; and h. a pair of oppositely positioned free spinning connecting means engagably attached to both said stationary platform gear means and said stationary main shaft carrier housing gear means so that, when said exerciser pedals, said free spinning connecting means rotates about both said stationary gear means thereby allowing said support platforms to rotate while being held in a fixed position.

2. Fixed exercise platform apparatus as recited in claim 1, wherein:

said free spinning connecting means is in the form of a timing belt means.

3. Fixed exercise platform apparatus as recited in claim 1, wherein:

said free spinning connecting means is in the form of a timing chain means.

4. Fixed exercise platform apparatus as recited in claim 1, wherein:

said free spinning connecting means is in the form of a gear.

5. Fixed exercise platform apparatus as recited in claim 1, wherein:

said stationary gear means are in the form of sprockets.

6. A method of providing for a fixed exercise cycling platform apparatus for supporting an exerciser comprising the steps of:

a. providing a pair of support platforms upon which an exerciser's feet may be placed;

b. attaching resilient cushioning means to said support platforms for cushioning said exerciser's feet;

c. attaching one end of a pair of platform shafts to the base of said support platforms so that said support platforms may be positioned at any desired angle and held there;

d. attaching a pair of stationary platform gear means to said platform shafts at the end of said platform shafts opposite from said support platforms;

e. attaching one end of a pair of spacing and support bars securably to platform shaft carrier housings, which surround said platform shaft between said support platforms and said stationary platform gear means and which include bushings so that said platform shaft rotates freely within said shaft carrier housings;

f. attaching a main shaft to the ends of each said spacing and support bars opposite from said platform shaft carrier housings;

e. attaching two oppositely positioned stationary main shaft carrier housing gear means, aligned with said stationary platform gear means, to a main shaft carrier housing, which encloses said main shaft and includes bushings which enable said main shaft to rotate freely; and h. attaching a pair of oppositely positioned free spinning connecting means to both said stationary platform gear means and said stationary main shaft carrier housing gear means so that, when said exerciser pedals, said free spinning connecting means rotates about both said stationary gear means thereby allowing said support platforms to rotate while being held in a fixed position.

* * * * *